US005224785A

United States Patent [19]

Raar

[11] Patent Number: 5,224,785

[45] Date of Patent: Jul. 6, 1993

[54] RIBBON CASSETTE

[75] Inventor: Hans Raar, Vlijmen, Netherlands

[73] Assignee: Merlin C.T.C. Production Division Nederland B.V., Zevenaar, Netherlands

[21] Appl. No.: 872,436

[22] Filed: Apr. 23, 1992

[30] Foreign Application Priority Data

Apr. 25, 1991 [NL] Netherlands ..... 9100721

[51] Int. Cl.[5] ..... B41J 35/14

[52] U.S. Cl. ..... 400/213; 400/216

[58] Field of Search ..... 400/208, 196.1, 185, 400/216, 216.1, 216.2, 211, 213, 215, 217, 224.1

[56] References Cited

U.S. PATENT DOCUMENTS

| | | | |
|---|---|---|---|
| 3,974,540 | 8/1976 | Bonner | 400/197 |
| 4,606,662 | 8/1986 | Komplin | 400/216 |
| 4,657,418 | 4/1987 | Lahr | 400/208 |
| 4,854,027 | 8/1989 | Smith et al. | 400/196.1 |
| 5,067,833 | 11/1991 | Gomoll et al. | 400/216 |
| 5,123,760 | 6/1992 | Tsuru et al. | 400/216 |

FOREIGN PATENT DOCUMENTS

| | | | |
|---|---|---|---|
| 0244228 | 11/1987 | European Pat. Off. . | |
| 218178 | 9/1987 | Japan | 400/185 |

OTHER PUBLICATIONS

IBM Technical Disclosure Bulletin, entitled "Ribbon Feeding Device", vol. 2, No. 5, Feb. 1960.

*Primary Examiner*—Edgar S. Burr
*Assistant Examiner*—Ren Yan
*Attorney, Agent, or Firm*—Webb, Burden, Ziesenheim & Webb

[57] ABSTRACT

A cassette for a printer unit which includes an endless ribbon, a mechanism for transporting the ribbon, and a mechanism for causing the ribbon to move reciprocally comparatively slowly in a direction substantially transversely of the direction of movement of the ribbon. A camming track may be utilized for moving the ribbon wherein the driving of the camming track is coupled to the transporting mechanism for the ribbon.

7 Claims, 2 Drawing Sheets

RIBBON CASSETTE

BACKGROUND OF THE INVENTION

Ribbon cassettes are used for printing characters using a printer unit such as a typewriter or a printer unit coupled to a (micro)computer, wherein the number of characters for printing with one cassette for the printer unit is of great importance. Such a cassette is a disposable product of plastic and therefore has an environmental impact. Although laserjet and inkjet printing becomes more fashionable, such printing is expensive and therefor a high demand remains for inexpensive printed (or typed) matter showing high quality.

SUMMARY OF THE INVENTION

The present invention provides a cassette for a printer unit comprising:

an endless ribbon;

means for transporting the ribbon; and means causing the ribbon to move reciprocally comparatively slowly in a direction substantially transversely of the direction of movement of the ribbon.

Due to the reciprocating movement of the cassette, i.e. the ribbon, this ribbon, and therefor the cassette, is used as optimally as possible and has a longer life span. The printer unit does not require any special provisions for this optimal use of the ribbon.

Preferably the ribbon is of non-woven synthetic material, such as polyester, to which material the ink is coated. For improving printing quality matrix printing units make use of an increasing number of printing pins, viz. 24, 36 or even 48. Using such high number of pins the weaving structure of nylon ribbon becomes apparent on paper, which therefor has an adverse effect on such printing quality. More finely woven nylon ribbon is hard to find and very expensive.

It is expected that a cassette with a ribbon 12 mm wide and 5 m of length will be able to print 2.5 million characters on paper with substantially constant darkness. Because of the reciprocal movement of the ribbon all characters maintain the same degree of darkness over the height thereof, even such characters as g,l,y etc which show a projection from the central part of the ribbon.

For a 20 mm wide ribbon (length 5 m) the number of characters is expected to reach 3.5 million.

According to the preferred embodiments of the cassette of the present invention—see subclaims 2, 3 and 4—the construction is very compact, while it remains completely compatible with non-reciprocating or non-jogging cassettes. The printing unit remains unchanged while a higher number of characters for each cassette is obtained.

U.S. Pat. No. 4,854,027 shows a cassette for a printing unit provided with specially designed projecting means to be inserted into the cassette such as to operate certain mechanisms inside the cassette.

BRIEF DESCRIPTION OF THE DRAWINGS

Further advantages, features and details of the present invention will become apparent in the light of a description of a preferred embodiment thereof with reference to the annexed drawing, in which.

DESCRIPTION OF THE PREFERRED EMBODIMENT

Figure 1:
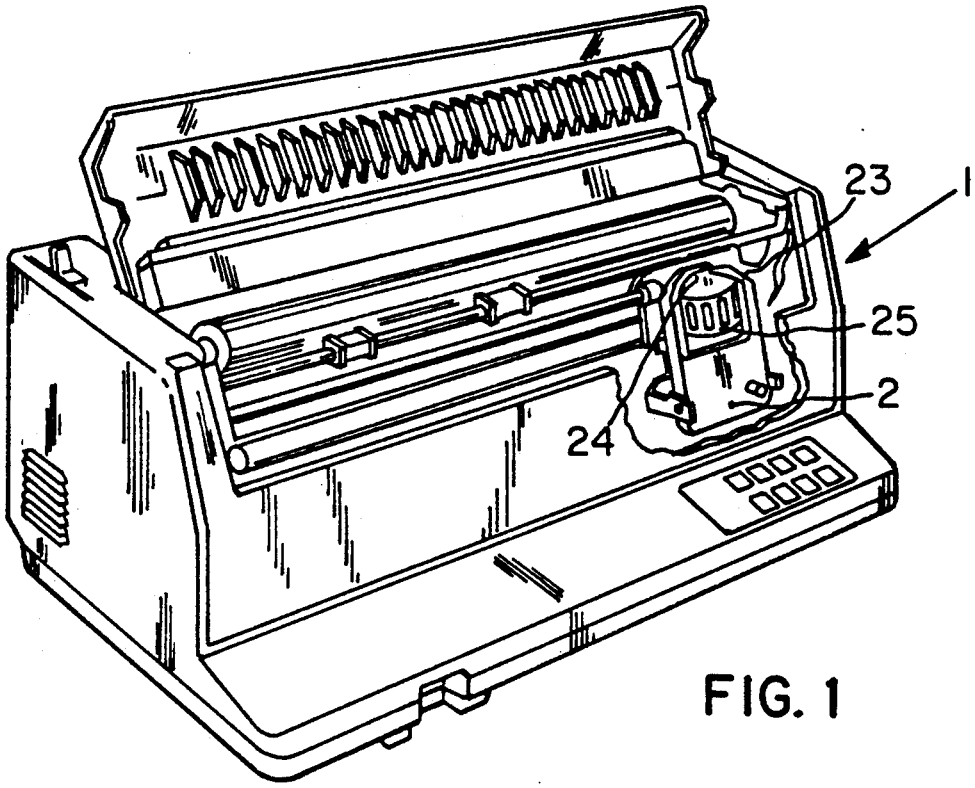
FIG. 1 shows a perspective, partially broken away view of a printer unit with a preferred embodiment of a cassette according to the present invention.

A printer unit 1 (FIG. 1) is provided with a cassette 2 of which arms 23, 24 extend beyond a printing head 25.

The cassette 2 (FIG. 2) is driven by means of a shaft or pin 3 from the printer unit 1. Gear wheels 4, 5, 6 form a reducing transmission of the drive shaft 3 to the last mentioned gear wheel on which is arranged a cam disc or plate 7. The gear wheels 4, 5, 6 are arranged partly one above the other because of the limited space available in the embodiment shown according to the present invention.

Figure 2:
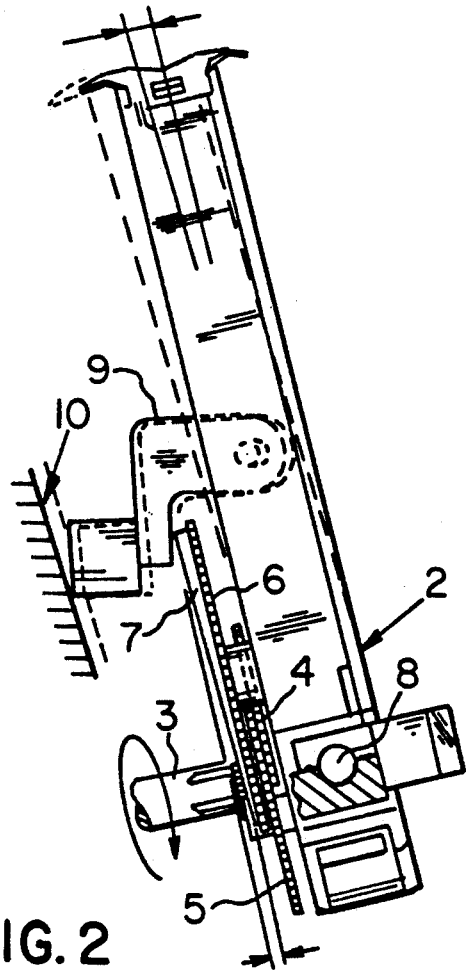
FIG. 2 is a side view of the cassette of FIG. 1.

Cassette 2 is further provided with pivot pins 8, of which only one is visible in FIG. 2, in addition to a swivel member 9 which is movable between the position drawn with full lines and the position drawn with broken lines. During this movement brought about by the curve track 7 the whole cassette 2 is moved around the pivot points 8 between the position drawn with full lines and the position drawn with broken lines.

The swivel or pivoting member 9 herein pushes against a contact surface 10 forming part of the printer unit.

Figure 3:
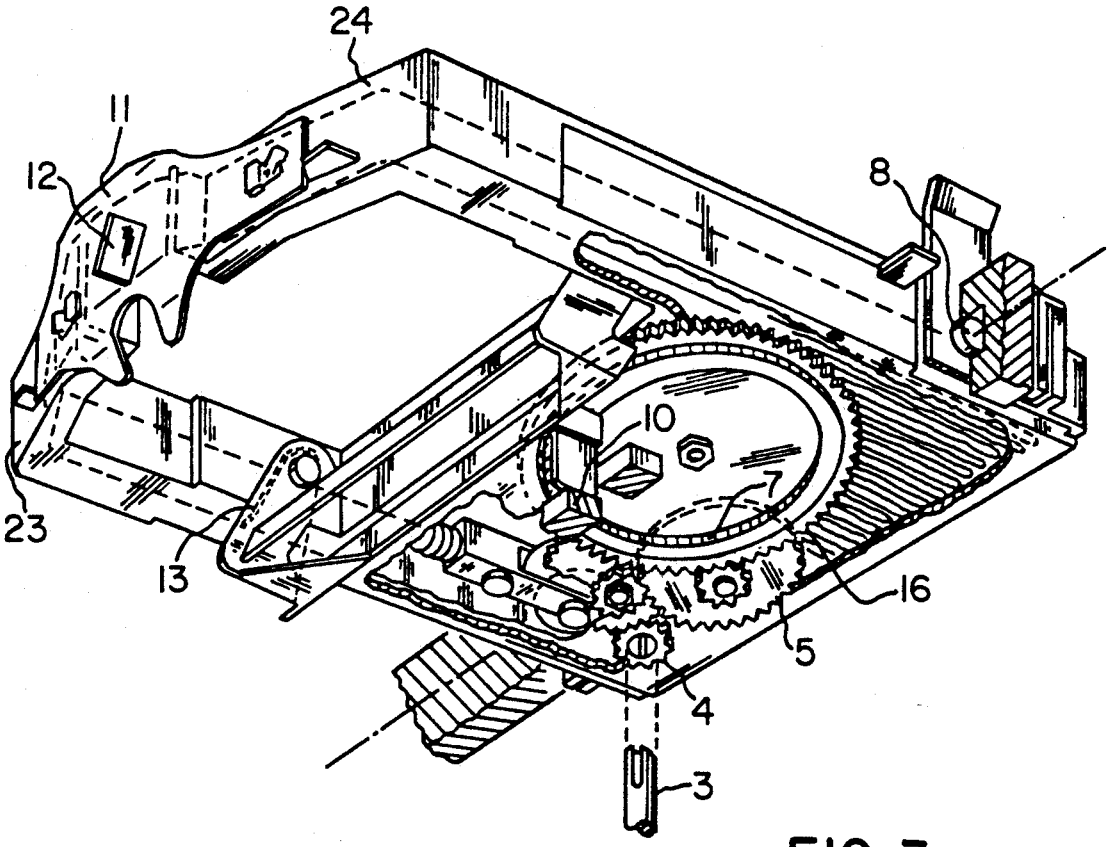
FIG. 3 is a view in perspective and partly broken away of the cassette of FIG. 1 (and 2).

In the view of the cassette shown in perspective in FIG. 3 can further be seen a mask 11 received between the arms 23 and 24 which is provided with a relatively large window 12 in order to be able to accommodate the movement of cassette 2. The pivotally attached member 9 can be swivelled between the arms 23 and 24 and can thus be placed in a packaging that does not need to be any higher than the thickness of the cassette. The swivel member 9 is preferably held in its active position by means of a spring 13.

A cassette according to the present invention is preferably used with a ribbon of so-called matrifilm or plastic carbon, wherein, in contrast to nylon ribbon, ink is not continually applied to the ribbon at each loop thereof. Tests with such ribbon in an ink cassette according to the present invention have demonstrated the probability that with the cassette according to the present invention 50% more characters can be printed without special provisions being required therefor in the printer unit.

It is noted that the present invention is not limited to the embodiment shown and described. The curved track on the disc can e.g. be provided with one or abrupt transitions in the curved surface. This feature is expected to further increase printing quality.

I claim:

1. A cassette for a printer unit, said cassette comprising:

an endless ribbon adapted for movement in a first direction;

pivot pins pivotally mounting said cassette about a pivot axis;

a drive shaft extending from said printer unit;

a reducing transmission coupled to said drive shaft;

a cam disc coupled to said reducing transmission; and a swivel member provided within said cassette;

said cam disc contacting said swivel member to pivot said cassette about said pivot axis, said swivel member pushing against a contact surface of said printer unit and said pivoting being in a plane perpendicular to said first direction.

2. A cassette as claimed in claim 1, wherein said cam disc is formed as a camming track, the driving of which is coupled to a transporting means for said endless ribbon.

3. A cassette as claimed in claim 2, wherein said reducing transmission is arranged for driving said camming track comparatively slowly relative to said transporting means.

4. A cassette according to claim 1, wherein said endless ribbon comprises a non-woven plastic material.

5. A cassette of claim 1, further comprising a spring for biasing said swivel member.

6. A cassette of claim 1, further comprising a pair of arms extending along the sides of said cassette.

7. A cassette of claim 6, further comprising a mask received between said arms; and a window provided in said mask which is sufficient to accommodate the movement of said cassette about said pivot axis.

* * * * *